US005540354A

United States Patent [19]

Annand

[11] Patent Number: 5,540,354

[45] Date of Patent: Jul. 30, 1996

[54] TOP DISPENSING TISSUE CONTAINER AND BULK TISSUE PACKETS

[75] Inventor: Charles A. Annand, Truro, Canada

[73] Assignee: B.F.A. Manufacturing Limited, Truro, Canada

[21] Appl. No.: 377,225

[22] Filed: Jan. 24, 1995

[51] Int. Cl.[6] ..... A47K 10/24

[52] U.S. Cl. ..... 221/52; 206/449

[58] Field of Search ..... 221/49, 48, 52, 221/51, 56, 45, 50; 206/812, 449

[56] References Cited

U.S. PATENT DOCUMENTS

| | | | |
|---|---|---|---|
| 427,516 | 2/1944 | Weeks . | |
| 1,579,429 | 4/1926 | Arms | 221/49 |
| 2,741,885 | 4/1956 | Allison | 53/198 |
| 3,030,750 | 4/1968 | Lowe et. al. | 53/124 |
| 3,057,134 | 10/1962 | Lallemand | 53/124 |
| 3,513,628 | 5/1970 | Lee et al. | 53/124 |
| 3,606,082 | 9/1971 | Kuchenbecker | 221/52 |
| 3,650,087 | 3/1972 | Brinkmeier | 53/124 C |
| 5,332,117 | 7/1994 | Yadegar | 221/52 |

FOREIGN PATENT DOCUMENTS

| | | |
|---|---|---|
| 691447 | 7/1964 | Canada . |
| 854557 | 8/1970 | Canada . |
| 929899 | 7/1973 | Canada . |
| 1194453 | 7/1983 | Canada . |
| 2014080 | 4/1991 | Canada . |
| 2014331 | 5/1991 | Canada . |

*Primary Examiner*—Kenneth Noland

[57] ABSTRACT

Broadly the present invention provides a semipermanent and reusable container for facial tissue which will be of low cost molded plastic and which will use facial tissues from a standard commercial box or from a compressed individual packet or from a compressed packet removed from a bulk pack of tissue packets, and where the tissues will be removed vertically from the top opening, one tissue at a time. An internal control plate will control the subsequent removal of tissues from the packet inside the container one tissue at a time and will also assist in holding the tissue vertically for ease of removal. The container is fitted with a detachable bottom to support the packet of facial tissues. The packets are from a compressed packet of tissues or from a standard box of loose packed tissues. The tissue packets may be contained within a poly pack and with an integral carrying strap and which may also contain the dispenser and its basic plastic parts within the poly pack to reduce packaging and shipping costs.

16 Claims, 11 Drawing Sheets

TOP DISPENSING TISSUE CONTAINER AND BULK TISSUE PACKETS

BACKGROUND

1. Field of Invention

This invention relates to a top opening tissue dispenser of a reusable and semipermanent nature for serially dispensing interfolded and interleaved tissue sheets, one tissue at a time, and a method of producing compressed packets of tissues and a bulk pack for these packets which can also contain the dispenser.

2. Cross Reference to Related Applications

The enclosed invention relates to the inventor's previously applied for U.S. patent application No. 08/237,863—filing date May 4, 1994—and titled "DISPENSER FOR FOLDED SHEETS AND BULK PACKETS". The inventor describes and claims a folded sheet dispenser in five embodiments where folded sheets are dispensed "one at a time" from an end opening in the container, in a horizontal direction, which are controlled by an internal control plate. This controls the progressive removal of the sheets. This invention also teaches a method of producing compressed sheet packets of a set count and restrained by a wrapper. The packets are then combined in multiples of packets and poly wrapped or placed in a poly bag to form a Bulk Pack of packets with a carrying handle.

This invention also relates to the inventors previously applied for Canadian Patent application, Ser. No: 2097527, dated Jun. 02, 1993 and entitled "TISSUE BOX FOR BULK TISSUE PACKETS". The inventor makes claim for a facial tissue container with an end opening for the progressive removal of facial tissues one at a time. This previous invention of an end opening container for bulk tissue packets was for a free standing container.

A second Canadian application, Ser. No: 2,105,245, dated Aug. 31, 1993, entitled "FACIAL TISSUE CONTAINER FOR MOUNTING UNDER A STRUCTURE", includes the same embodiments of the first application except that the container has been inverted and mounted horizontally under a support structure which also uses bulk packets of tissues from a bulk pack.

A third Canadian application, Ser. No. 2,102,163; dated Nov. 1, 1993 and titled "TOP DISPENSING BULK TISSUE CONTAINER" is a dispenser where the claims stated are for a semi-permanent and reusable tissue dispenser where the tissues are removed through the top opening of the container, one tissue at a time. They are controlled by an internal control plate through which the tissues are removed in a vertical direction. This invention also uses compressed tissue packets of a set count from a Bulk Pack of tissue packets which are enclosed in a poly wrapper with a carrying handle. This patent forms the basis for this enclosed United States Patent application.

A fourth Canadian Patent application, Ser. No. 2,117,110; dated Mar. 7th, 1994 and titled "DISPOSABLE TISSUE DISPENSER" teaches a container of disposable cardboard and of the same art as the previous patent applications by myself as the inventor, is similar to Canadian Ser. #2,097,527 application except that the claims are made for a "disposable" cardboard container. The tissues are dispensed through an end opening in a horizontal direction and they are controlled by an internal control plate of heavy cardboard. The dispenser uses interleaved loose packed tissues placed in the dispenser at the manufacturing plant.

3. Discussion of Prior Art

Heretofore, as disclosed in the prior art on sheet dispensing devices when the sheet was removed from a top opening dispenser, these units could be divided into two groups as follows. Those where the tissue is controlled by the top surface of the container and which allows the tissue to be removed and grips the next tissue to prevent it from falling back into the dispenser as taught by K. M. Enloe, dated Feb. 20, 1968, U.S. Pat. No. 3,369,699; which teaches the use of a pair of planar lip like constricting members—to grip the tissues.

Again in the invention by H. N. Nelson, dated Feb. 6th, 1962, U.S. Pat. No. 3,019,944; teaches the use of a narrow slot"—generally key shaped panel disposed in a co-planar portion—" which grips the tissues, as they are removed at the top surface of the container.

Also in the patent by H. Scholz, dated Feb. 20, 1968, U.S. Pat. No. 3,369,698; also teaches an improved arrangement of the tissues themselves and which are removed from a slot or flexible lip material to grip the successive tissues at the top level of the container.

The second group of patents generally teach a method of tissue control where an internal control plate had a slot or opening through the plate to control the tissue. A opening in the top of the container as taught by the invention of D. T. Scott, dated Sep. 21, 1965, U.S. Pat. No: 3,207,360; where the "—receptacle and a light weight, substantially flat discharge control plate—" and which "—moves up and down in the receptacle when the stack of sheets becomes partially depleted,—".

Again in the invention by D. T. Scott, dated Sep. 1966, Canadian Patent 742,552; he teaches the same use of a "—substantially flat discharge control plate—" and "—movable upwardly during withdrawal of the uppermost tissue—".

Also H. M. Nelson, dated Jan. 1968, Canadian Patent 775,998; teaches an internal plate of various shapes and with various shaped openings which is substantially flat and moves upward with the tissues when they are removed and has perforated cut score line in the top cover of the disposable container which determines the shape of the internal control plate.

Again one of the earliest U.S. Patents for a dispensing device was by D. W. Hudson, dated Aug. 1923, U.S. Pat. No. 1,462,180; which teaches a control plate that is curved like a half cylinder and not flat and has a slot to allow the dispensing of a folded napkin and remains substantially motionless and exerts a "—constant downward pressure—upon the stack of interfolded sheets—".

Generally, the tissue dispensing containers are all of a disposable nature with internal floating plates, and have been abandoned for the popular top gripping tissue containers for tissue control. However, these containers have a tendency for the tissues to drop back into the container when they are partially depleted and the top opening does not easily allow the hand or fingers to be placed inside the container to remove the next tissue. These disposable containers, although widely used, have proved to be inconvenient and wasteful when they contain a number of tissues over one hundred and approaching three hundred tissues.

All the previous inventions have taught an internal control plate of light weight and substantially flat which moved vertically within the container for the full height inside the container and moved upward with the tissue as it was withdrawn and then fell back by gravity. This falling back had the tendency to pull the tissue down into the container which proved inconvenient and undesirable and caused their abandonment. Although the large top opening allows the hand or fingers to be thrust inside the container to remove a tissue, this further damages the cardboard control plate. Also the tissues were not visible at all times which caused the user to think the container to be empty and this too led to the abandonment of the invention. All these dispensers were for facial tissues except the invention by Hudson in 1932, which was of a dispenser for a much heavier sheet material such as table napkins and therefore would appear to be of a much heavier material such as wood or metal. The rigid control plate of a heavy weight forced the sheets to remain somewhat compressed and were held down at the extreme edges by the barrel shape of the plate. Hudson could not have used cardboard for his dispenser and it could not have been suitable for facial tissues as they would have torn as they were removed from under the heavy control plate. Hudson teaches a different dispenser from the other facial tissue dispensers of the 1960 period and although it teaches the dispensing of sheet material it would not have worked for facial tissues were the tear strength of the tissues is much less than paper napkins.

4. OBJECTS AND ADVANTAGES

Accordingly, several objects and advantages of my invention are a control plate which is substantially different and teaches a new control means over the succeeding plies of tissues to allow them to be removed in a supported vertical direction and the tissue then protrudes through the elongated opening in the top of the permanent container. An elliptical opening is shown in our drawings for convenience. However, the shape of the opening can be of an ellipse as shown, and in the drawing showing alternate shapes, a parallelogram and a rectangular with round ends perform equally as well when the critical length and width dimensions of the opening are engineered to be less than the length and width of the interleaved tissue. The substantial design weight of the control plate is one of the most important factors effecting the removal of the tissue in that the weight of the control plate, as it lays on the top most tissue, assists in holding the tissues vertical. The control plate edges maintain a constant pressure on the tissues which transfers to the friction between the interleaved tissues at a set distance inside the edges. The control plate, has an engineered shape with a crown on the longitudinal centerline, and promotes the tissues to flow from side to side underneath the control plate. The unrestricted space provided by the crowned shape of the plate allows the plate to oscillate, from alternate sides, inside the container as is shown in FIG. (9). As a tissue is withdrawn it lifts the edge of the plate to cause it to oscillate while maintaining a controlled pressure on the top most tissue applied inside at the outer edges of the tissue and the control plate has one of its two edges in contact with the top tissue at any given time. The control plate controls the inter ply friction between the successive layers of the facial tissue. As is shown in FIG. (8) the control plate is in the normal flat position, and the weight of the plate, from tests conducted was found to weigh between 50 and 60 grams (and should be of a ridged material to maintain a smooth surface to prevent the tissues from snagging on the underside or on the edges of the control plate. The weight and shape of the control plate also supports the upward extending tissue in a somewhat vertical position. This action of the plate will allow the tissue, which protrudes through the slot in the control plate, to be held vertically by the weight and sloped space under the plate and the tissue will be supported as it extends up through the top opening of the container or dispenser where it can easily be removed, one tissue at a time. If the tissue drops below the top opening in the container it still can be easily removed through the extra large opening in the top of the tissue container. The opening in the control plate by its width and length gives a roll or hem effect to the extended edges of the tissue as it is being removed. This increases the ridigity of the upward extending flexible tissue when it is pulled up vertically by the preceding tissue which now has been completely removed from the container.

The use of a semipermanent and reusable facial tissue container in my invention, rather than a disposable cardboard tissues container, allows the container to be constructed from a durable and semi-ridgid molded plastic. This results in a stronger and more durable tissue dispenser. The control plate would also be made from this same low cost material which has good design characteristics that would allow it to perform better than a control plate from cardboard. These control plates, as were taught in the before mentioned patents, were of a disposable design and generally constructed of cardboard.

The container or dispenser as envisioned in my invention is of a semipermanent nature and must have a removable bottom to support the packet of facial tissues which are placed inside the container when the bottom is removed. The removable bottom is as shown in FIG. (2, 3 & 7) and may be made of molded plastic and would be fitted with felt pads to prevent damage to furniture surfaces and with Velcro (Velcro Canada Ltd., Quebec, Canada.) pads to allow the dispenser to be held in place on the seat fabric or floor mats of an automotive vehicle.

Because my invention is of a semipermanent facial tissue container the disposable cardboard box of the previously available dispensers of facial tissues is no longer necessary or desirable in that it causes excessive waste at landfill sites. With a semipermanent container, as shown in FIG. (7), the tissue packet is placed within the container and supported in place by the removable bottom. The restraint paper or plastic sleeve on the packet can be removed as the packet is placed in the container. The compressed packet of tissues can be a separate individual package or can be contained within a bulk pack of multiple packets. The bulk pack of compressed tissue packets contained by a recyclable plastic bag or wrapper with a carrying handle would be as shown in FIG. (10) through (13) where a single tissue packet is compressed and restrained and then combined with other similar packets to form a bulk pack of tissue packets.

A bulk pack can be comprised of any set number of packets, of a reasonable weight to be carried, which would result in a lower per tissue cost to the buyer and result in substantially less material to our landfill sites. This will result in savings to the manufacturer of the disposable boxes, shipping cartons, as well as cost savings for shipping and warehousing in that the tissue packets are reduced in volume. My invention, of a reusable and semipermanent molded plastic facial tissue dispenser with the compressed tissue packets in bulk packs will result in reduced costs to the manufacturer and therefore cost savings to the user and home owner.

Where in the disposable cardboard box is discarded to the landfill or paper recycling plant our durable but relatively lightweight plastic container, produced at a reasonable cost, would last for a number years. Numerous tissue packets would be used over the useful life of the dispenser. The savings of the disposable, throw-away, cardboard tissue boxes over the life of the container would be substantial. With the large size boxes, 300 tissue, the weight of cardboard in the ox is 64 grams (2.26 oz) and this weight of cardboard would be saved by 3 or 4 times at any one location in an average household. In 1992 the "—estimated size of the United States market of single two-ply Facial Tissues was 186 Billion individual tissues—" or 320 million large size, 300 tissue, boxes or 49,000 tons of cardboard. This would have destroyed 500,000 trees. The adoption of my proposed invention of a semipermanent facial tissue dispenser and compressed tissue packets would save a major portion of this annual waste in the United States and even a greater volume of waste and loss of tress in North America and the world.

The facial tissue top opening box has been the most popular dispenser for facial tissues in the home and office and also in Hotel/Motel rooms and automobiles and wherever people function. The top opening boxes of a quantity of 150 and 175 tissues have been the most popular size and now the manufacturers, in order to produce a more economical quantity of tissues, have made a box of 300 tissues, using the same top opening "pop-up" box design for the tissues. After the tissues are partially used they tend to fall back into the box and are difficult if not impossible for children and others to remove conveniently and quickly. The cardboard boxes of 300 tissues have double the number of facial tissues as the original 150 tissue boxes with the same "pop-up" design features. This worked well with the original boxes of 150 tissues but has become a source of annoyance and waste when used with the larger 300 tissue boxes. The manufacturer, for a slight increase in the cost for the added cardboard, increased the height of the 150 tissue box to now receive 300 tissues and for a small increase in cost they now offered double the number of tissues. However, the 300 tissue boxes never did perform as well as the 150 tissue boxes in that the tissues fell down into the box. This was a hidden cost for the tissues which were unused but yet discarded. Because the 300 tissue boxes are in use longer they become soiled or crushed and become totally wasted and what was meant to be an economical benefit to the homeowner has become a more costly inconvenience. Again with the automobile use the boxes become dirty, soiled and crushed to a state beyond their practical use and are never where they are required and are never within easy reach of the driver. This has become a cause of irritation and the cause of a possible accident.

An object of this invention is to provide a facial tissue container which will be of a semipermanent and reusable nature and can be washed and made clean by sanitary means. The dispenser is designed to use individually wrapped compressed tissue packets or compressed tissue packets from the economical bulk packs of compressed tissue packets which will then replace the card board disposable boxes and the disposable shipping cartons for these boxes. This will then reduce the volumes of waste to our landfill sites and be environmentally friendly in that the trees and energy to produce these disposable boxes will not be required.

A further object of the invention is to provide a semipermanent container which will give the convenience of a dispenser where the tissues can be removed one tissue at a time to the very last tissue in the dispenser. The dispenser will use loose tissues removed from a conventional disposable cardboard box or from the economical compressed packet of tissues from a bulk pack and will give the convenience of the "pop-up" feature when removing a tissue.

A further object of my invention is to provide a semipermanent, top opening, dispenser with an internal control plate which will allow the facial tissue, when removed, to cause the next interleaved facial tissue to be pulled up through the control plate. The tissue then extends up through the top opening of the dispenser where it will be readily visible and be supported by the top opening of the dispenser and can be removed conveniently with one hand, as is shown in FIGS. (2, 8 & 9), where the tissue is shown extending through the top of the dispenser and where it is supported vertically by the shape and weight of the internal control plate.

A further object of my invention is to provide a removable bottom to support a packet or loose pack of facial tissues which can be removed quickly and snapped back in place and shall have predetermined locations for felt or Velcro pads for the convenience of the user.

A further object of my invention is to construct the semipermanent container, control plate and the removable bottom from low cost molded plastic and preferably with thermo setting properties. The material will be semiridgid but flexible, washable, and of pleasing colors which can be further decorated by the purchaser or craft person to their own wishes.

Another object of my invention is to create a process by which the facial tissue packets are created from the existing manufacturers production line. The interleaved and inter layered tissues in a "C-Folded" or similar industry standard system are known as a "rope" of tissues and are carried on a feeder belt to a rotary cutter or by some other industry means where the rope of facial tissues is cut to a length in an automatic process, and placed in disposable card board boxes and sealed. They then are placed in card board shipping boxes and made ready for shipping. Where the object of my invention is to interrupt this production process and relocate the cutter station and add a conveyor belt compression station, or some other means, to compress the rope of tissues vertically. A feeder line is added for the restraint plastic strip or recyclable paper strip to enclose the rope of tissues and can be heat sealed or glued to restrain the tissues in a compressed state where the volume would be reduced in the order of 20 to 40%. The rope of tissues would be cut to the desired length by a cutter means and the compressed packets are then accumulated by known automatic means in lots of more than one to form pre-determined bundles of a desired number. They are then placed in or wrapped with a plastic poly wrapper to completely enclose the bulk pack of tissue packets and are then ready for warehouse storage or direct shipment.

Still a further object of my invention is to enclose the top opening dispenser inside the poly Bulk Pack and to have one or more of the tissue packets placed in the dispenser with the control plate and then to place the bottom plate elsewhere in the bulk pack. All as shown and detailed in the enclosed FIG. (14). The compressed packets and the dispenser would then be enclosed in and wrapped with poly plastic for shipping or warehousing. Shipping and packaging would be saved by enclosing the dispenser inside the bulk pack with the compressed tissue packets.

(5) BRIEF DESCRIPTION OF THE DRAWINGS

The invention will now be described merely by way of illustration with reference to the accompanying drawings in which.

Figure 1:
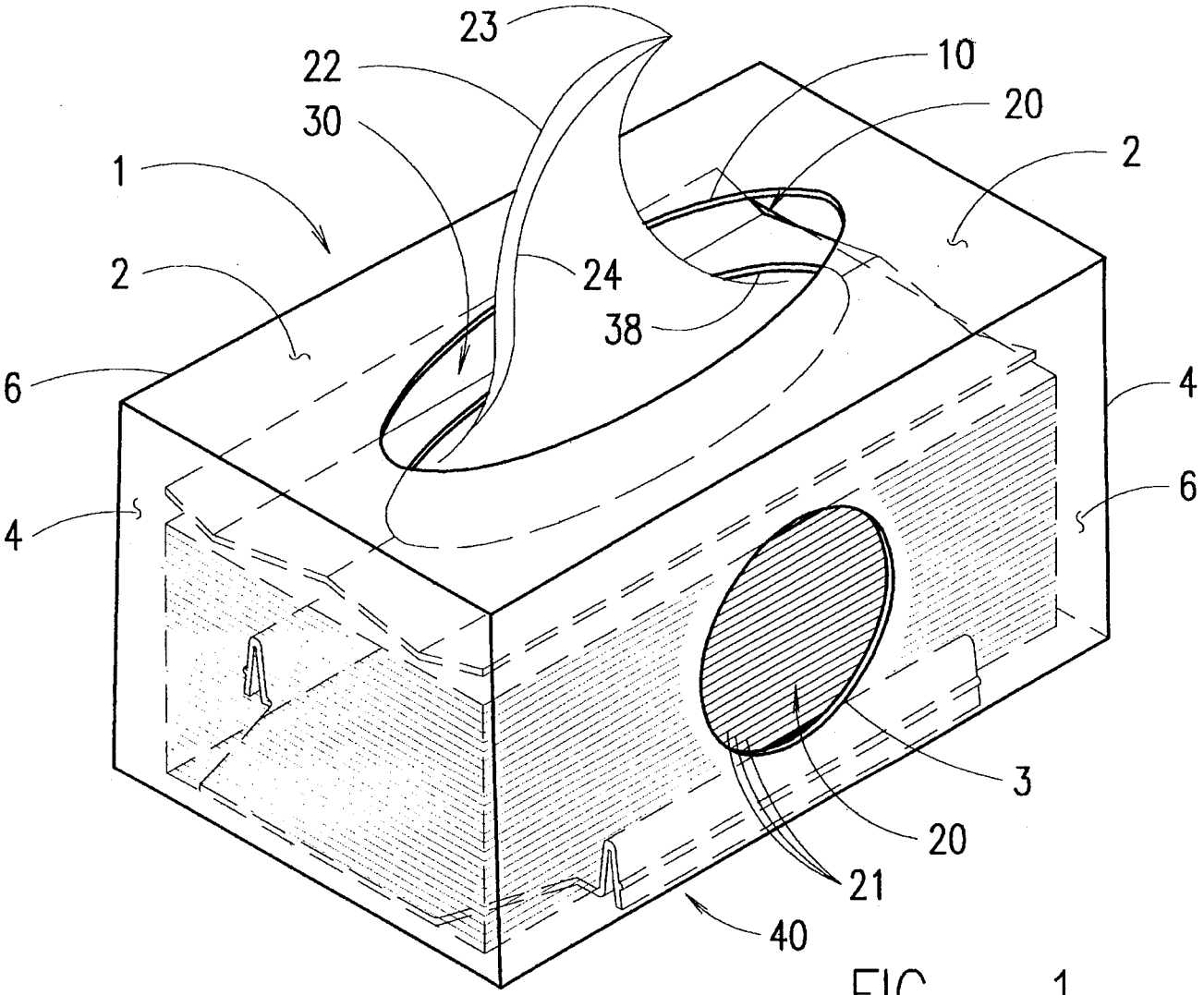
FIG. 1 is a perspective view of the facial tissue container as it would be used in a free standing mode wherein the tissue is being removed through the top opening.
Figure 3:
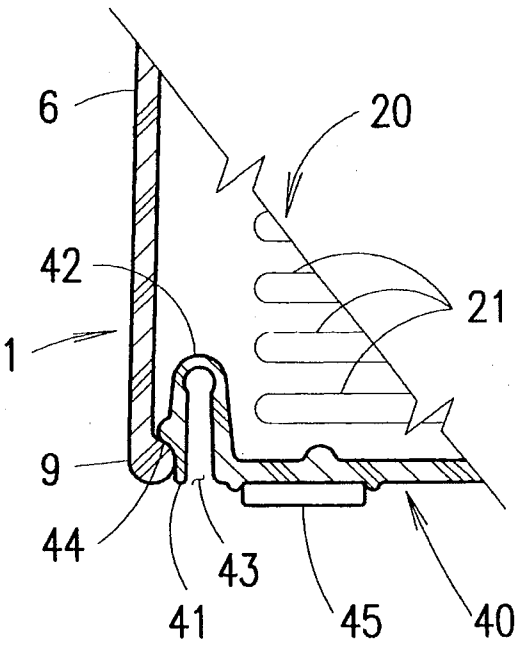
Figure 2:
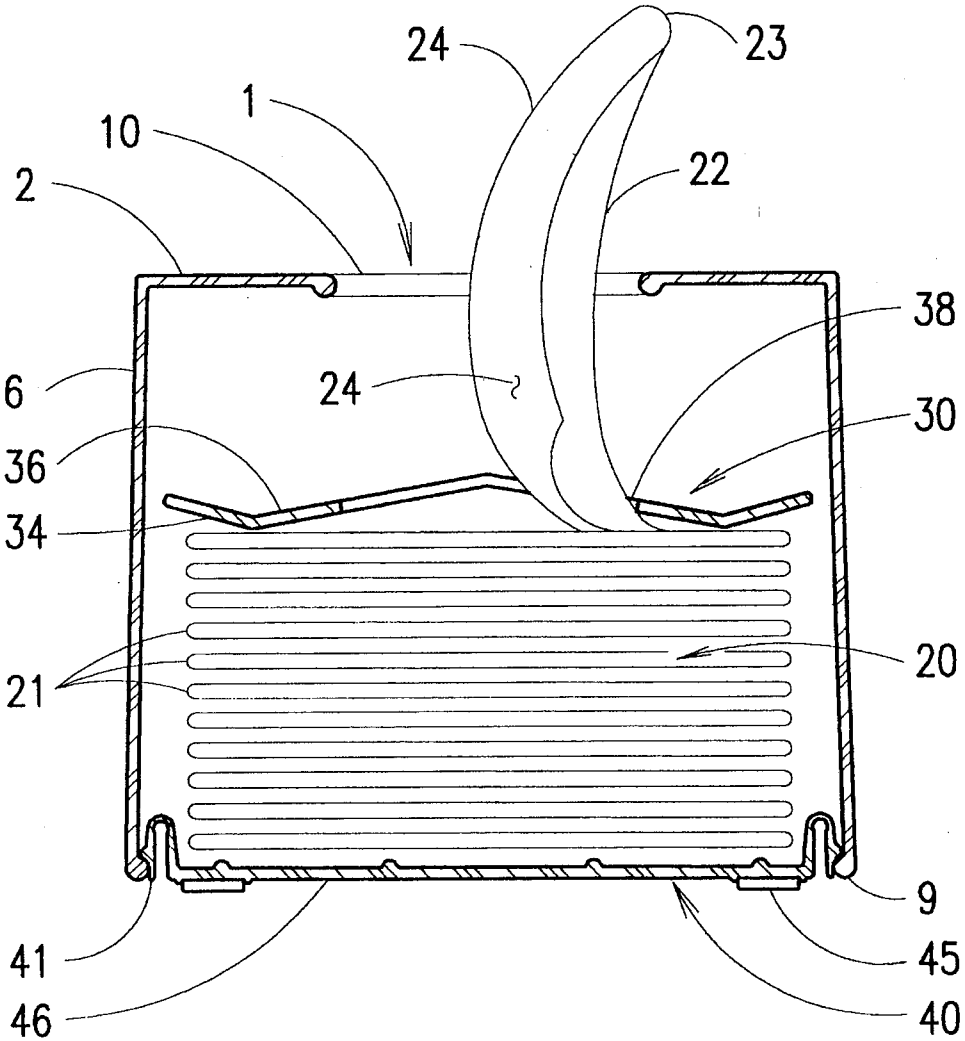
FIG. 2 is an end sectional view of the container with the packet of tissues enclosed showing a tissue being extended upwardly three the control plate opening and through the top opening in the container.

FIG. 3 is a sectional view of the corner detail at the wall of the container were the removable bottom is secured, in one possible method, inside the container by the live molded hinge which forms the parallel side walls of the bottom and which also shows the packet of facial tissues inside the container and supported by the bottom. The pad locations for the protective and attachment devices are as shown.

Figure 4:
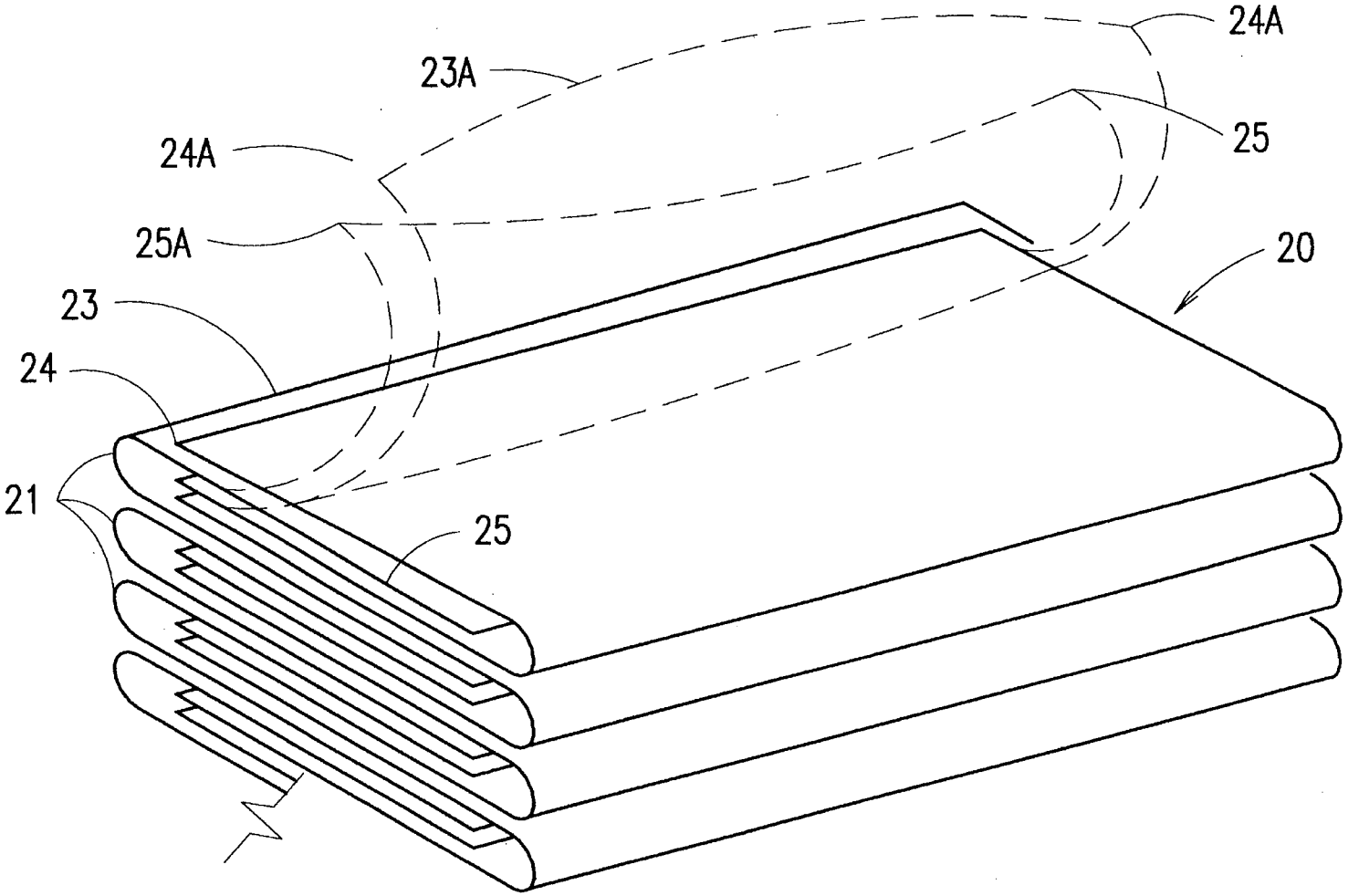

FIG. 4 is an isometric view of an individual packet of facial tissues which are interleaved in the C-Fold, an industry standard, and wherein the packet has a set width and length and of a set count to give the height and wherein a single tissue is being removed vertically upward which causes the next successive tissue to be extended vertically.

Figure 6:
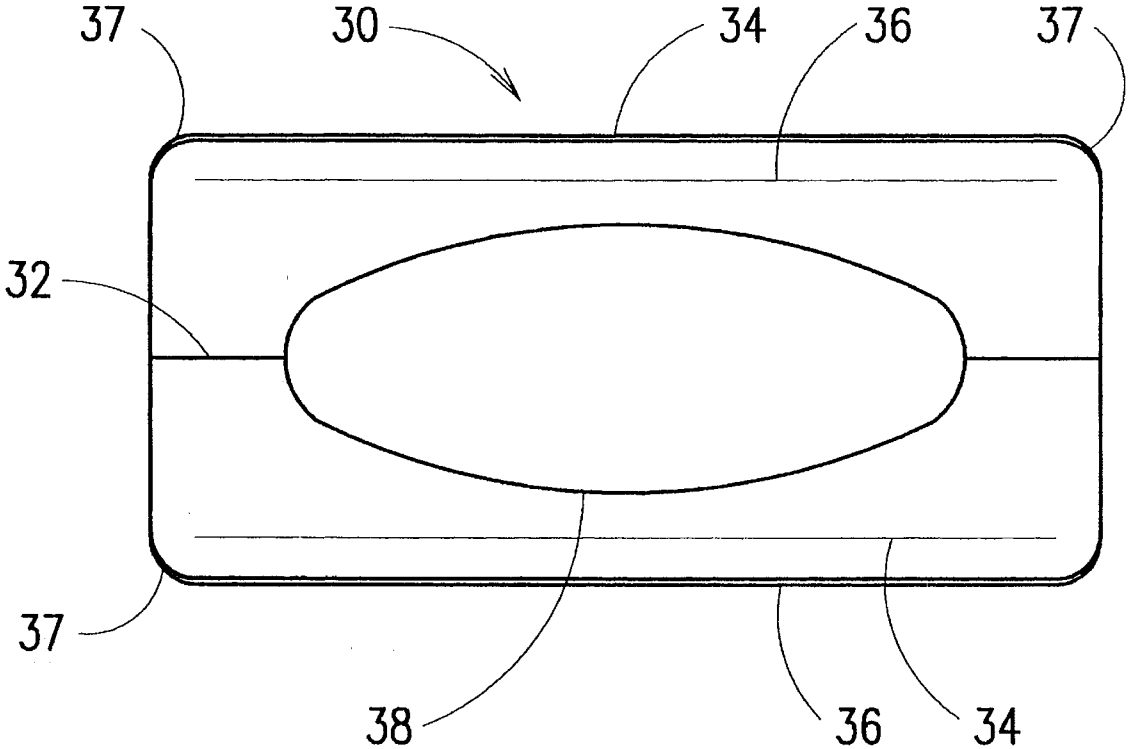
Figure 5:
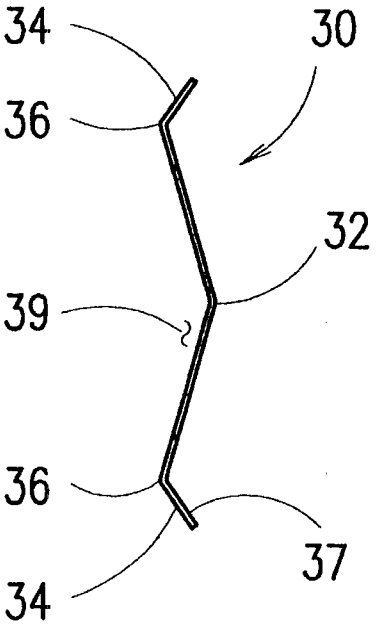

FIG. 5 & 6 are the end view and plan view of the molded plastic control plate which controls the removal of the tissues from the container and the opening in the control plate is shown on the longitudinal centerline of the plate and although this opening is shown as an ellipse other shapes will function equally as well to control the upward direction of the tissue as it is being removed vertically.

Figure 7:
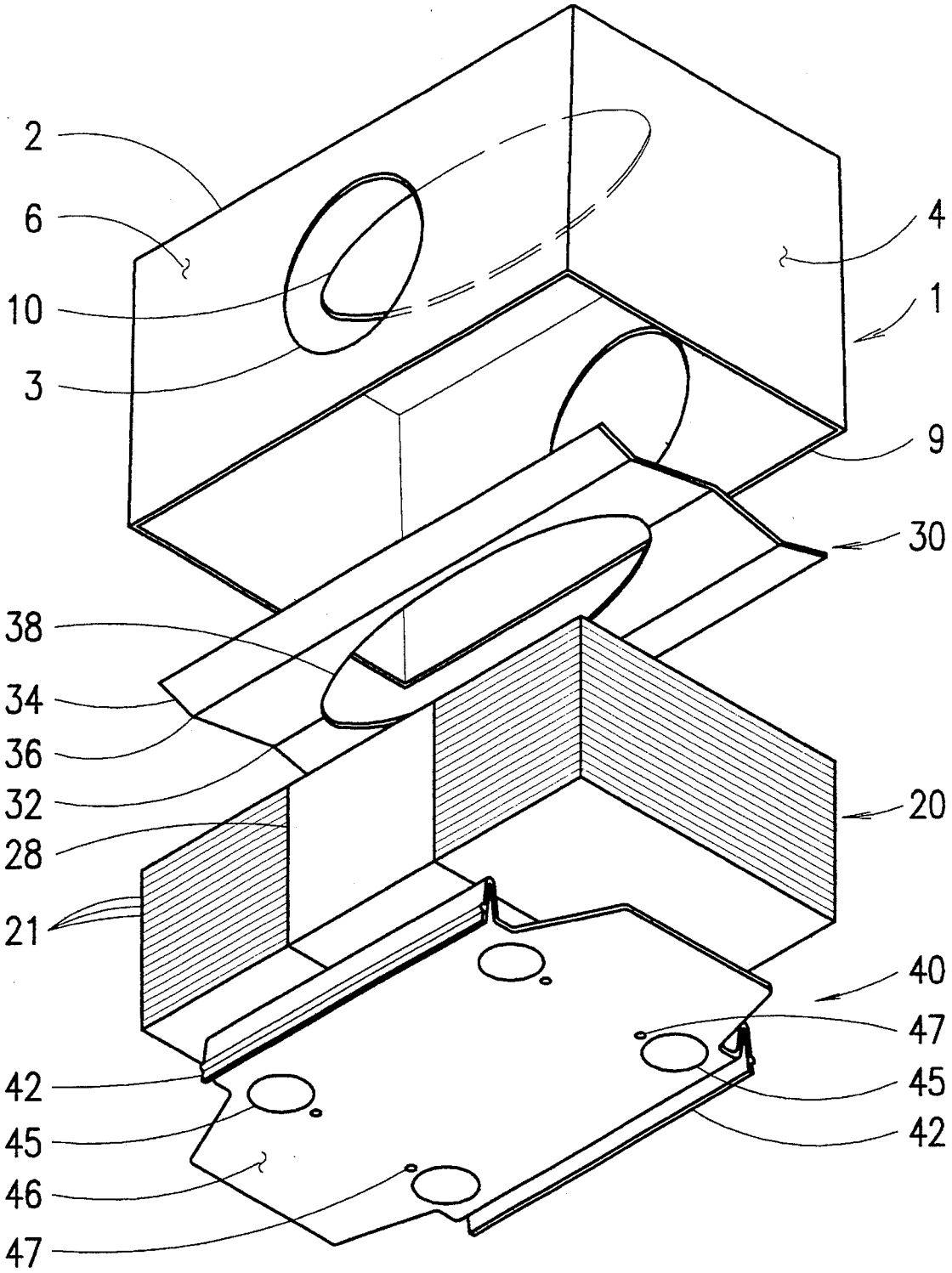

FIG. 7 is an exploded view of the parts which are essential to this facial tissue container system wherein the container is shown in the upper position which will receive the top control plate and the packet of facial tissues which is being restrained by a paper wrapper or plastic sleeve which is removed and then the bottom plate is placed under the packet of tissues and into the container.

Figure 8:
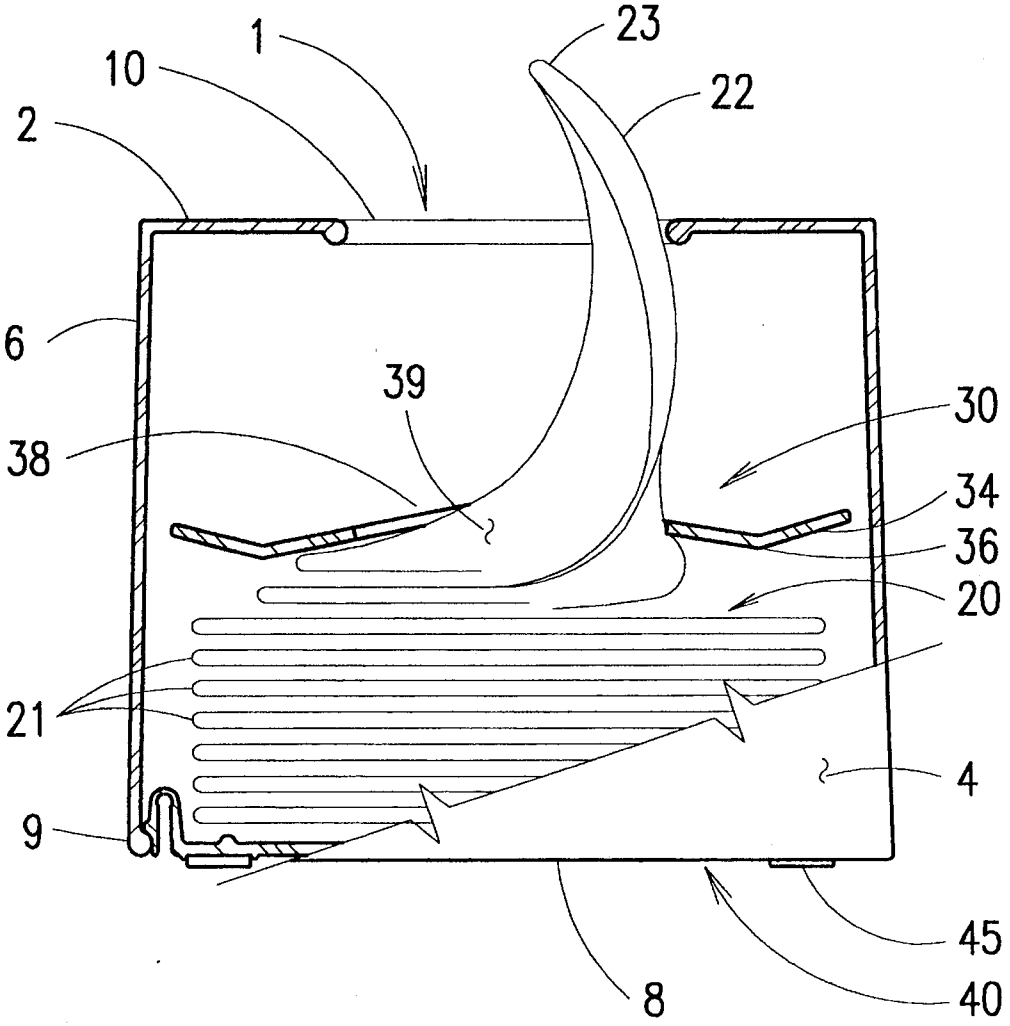

FIG. 8 is an end sectional view of the container showing the tissue being removed which flows underneath the control plate and is held vertically by the control plate and the top opening in the container.

Figure 9:
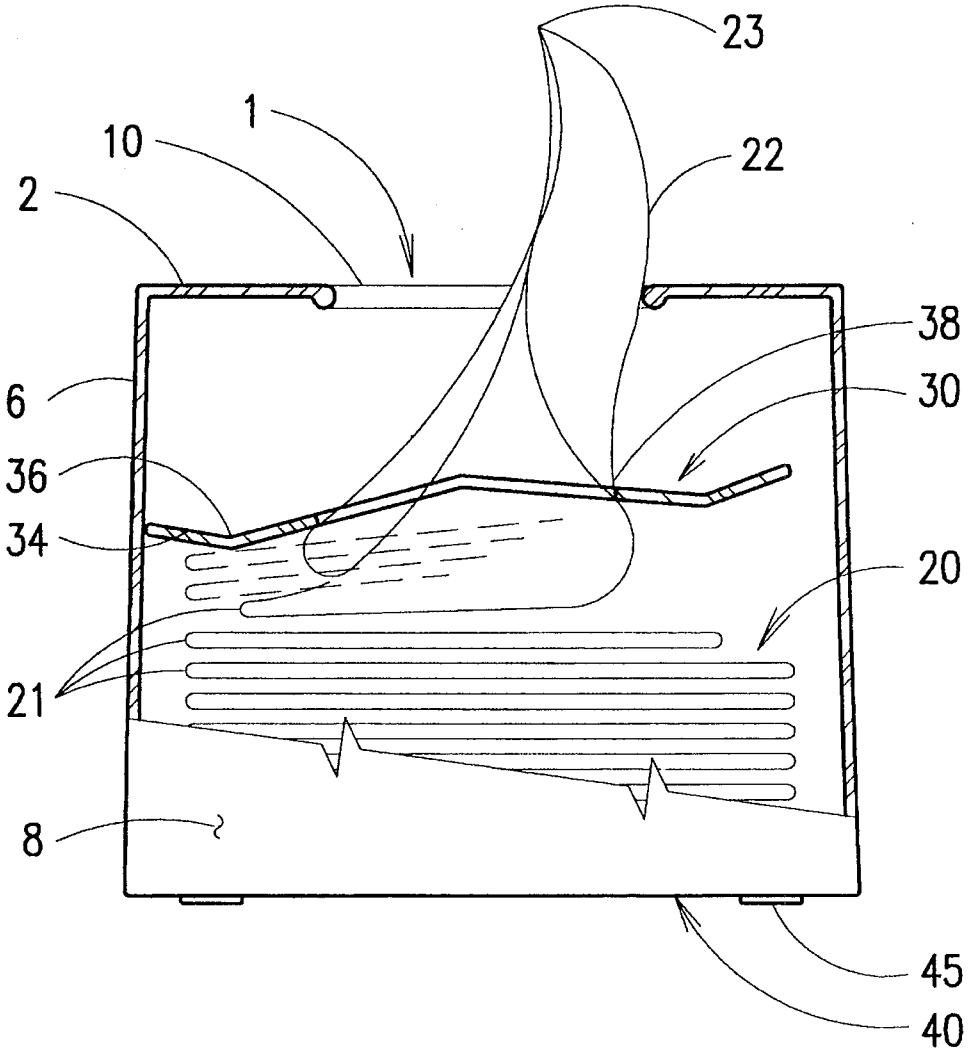

FIG. 9 is a sectional end view of the container showing the tissue being removed from the container from under the oscillating control plate which is caused by the removal of the tissue.

Figures 10, 11, 12, 13:
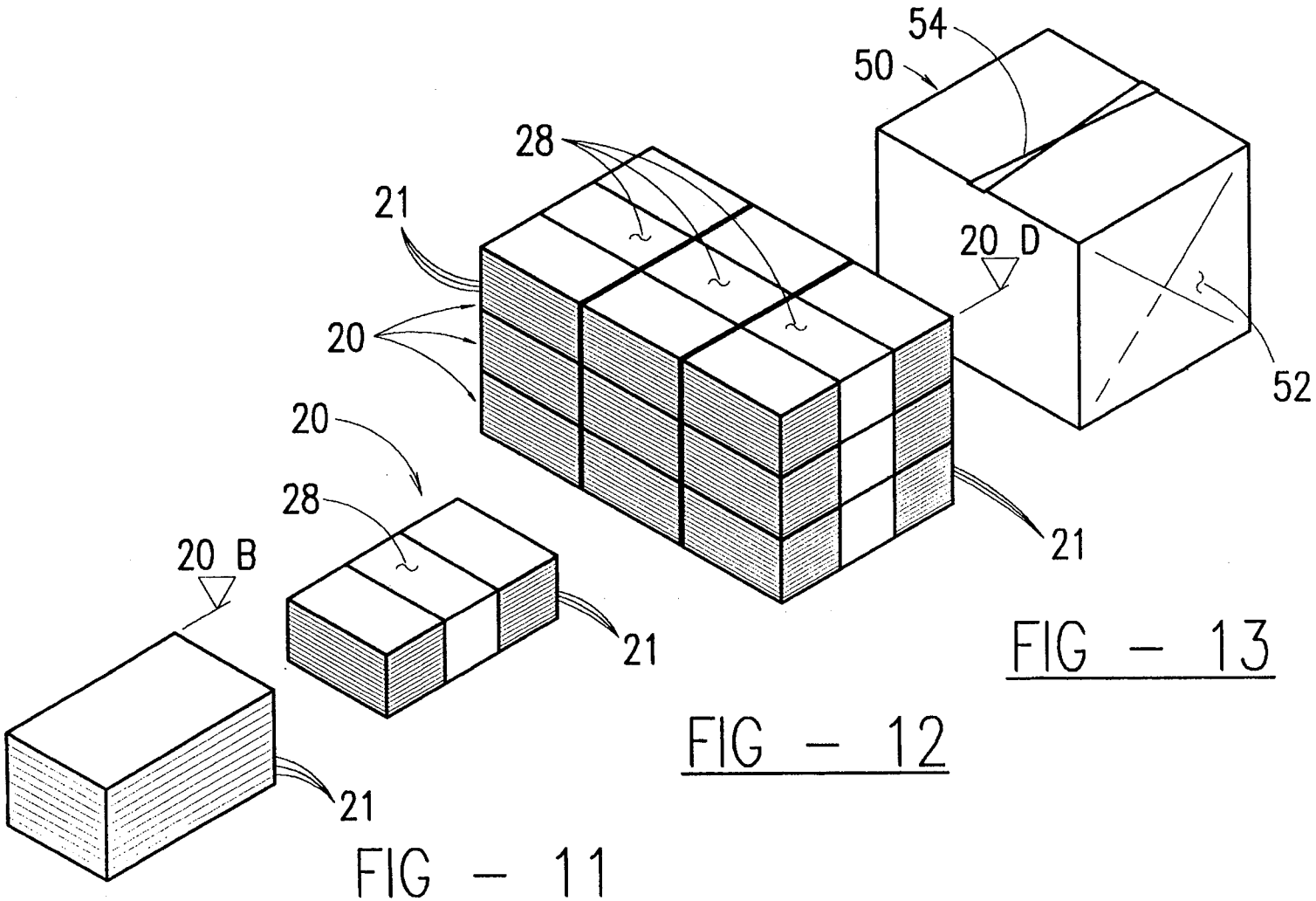

FIG. 10 is the complete packet of tissues of a set width and length and of a set count to give a set height as it is produced from the manufacturing line and where it would be cut to a set length.

FIG. 11 is the cut to length packet of loose tissues as it is compressed to reduce its volume and restrained by a paper wrapper or by a plastic sleeve.

FIG. 12 is a pre-set number of facial tissue packets in pre-determined lots where they form a block of a set width and height and where the length is determined by the pre-cut tissue packet length.

FIG. 13 is the plastic poly wrapper or bag which encloses the bulk block or pack of a set count of tissue packets with an integral handle or strap.

Figure 14:
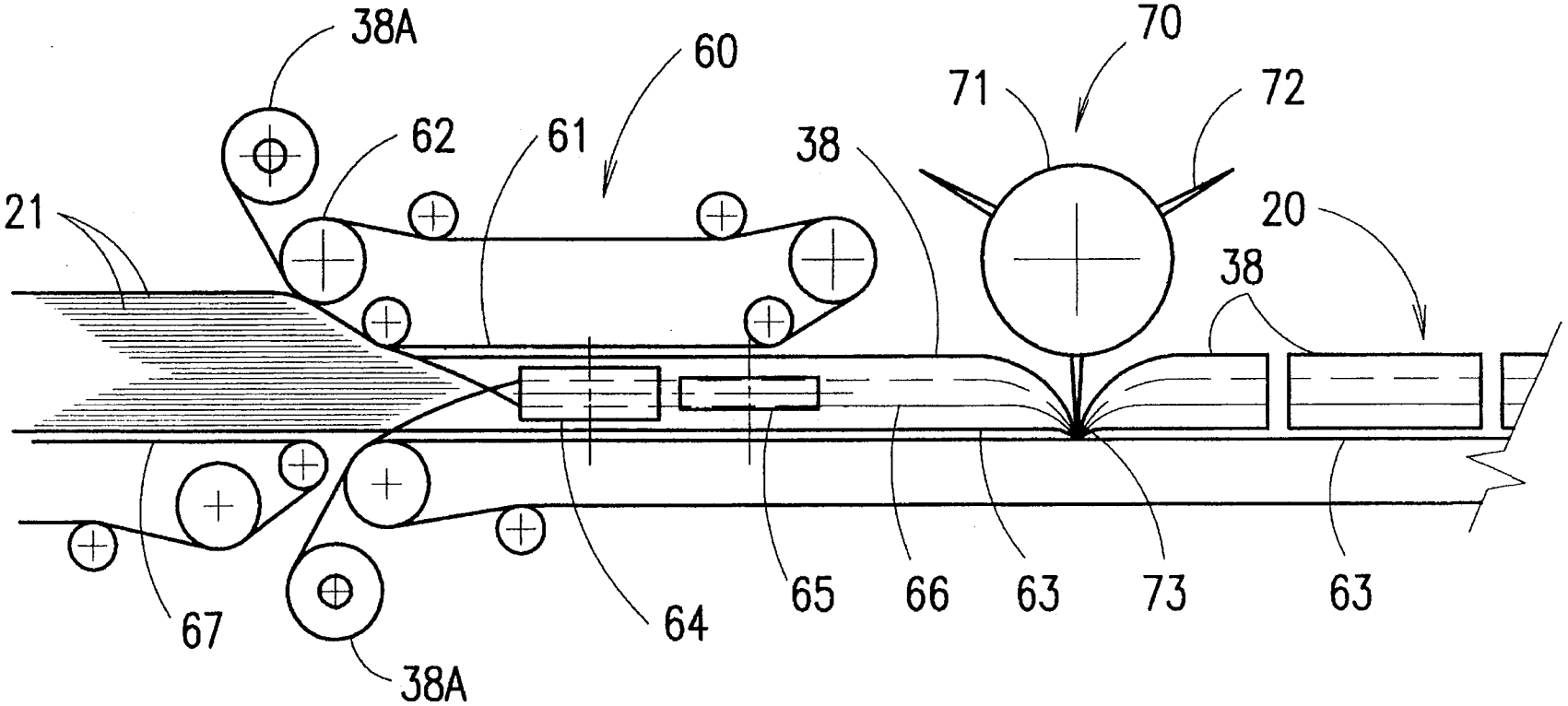

FIG. 14 is a possible method of producing the facial tissue packets with a compression and restraining means with a continuous wrapper with the cutting to length in a continuous production line.

Figure 15:
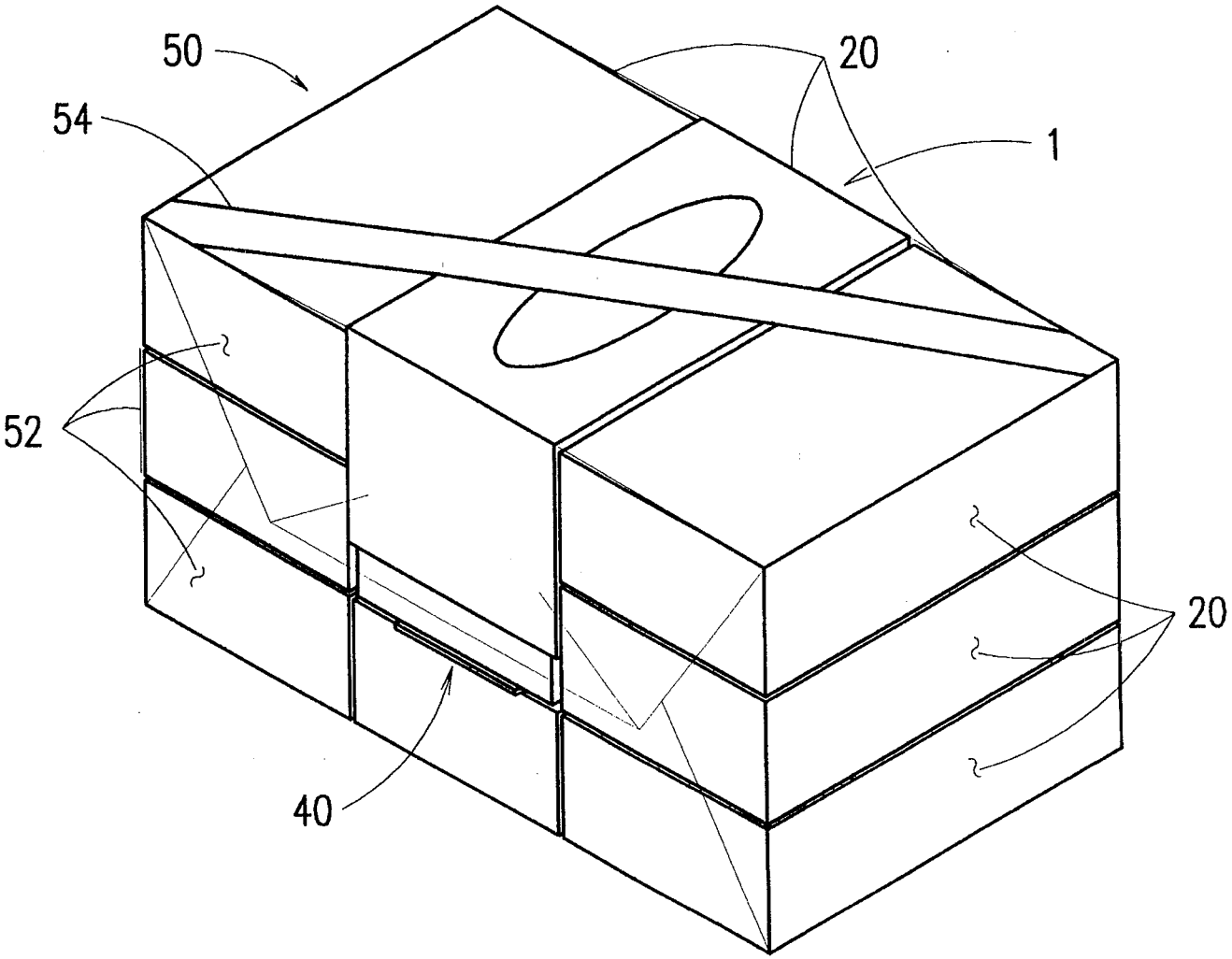

FIG. 15 is an isometric view of the bulk pack where the dispenser is enclosed within the plastic poly wrapper of the bulk pack.

Figure 16:
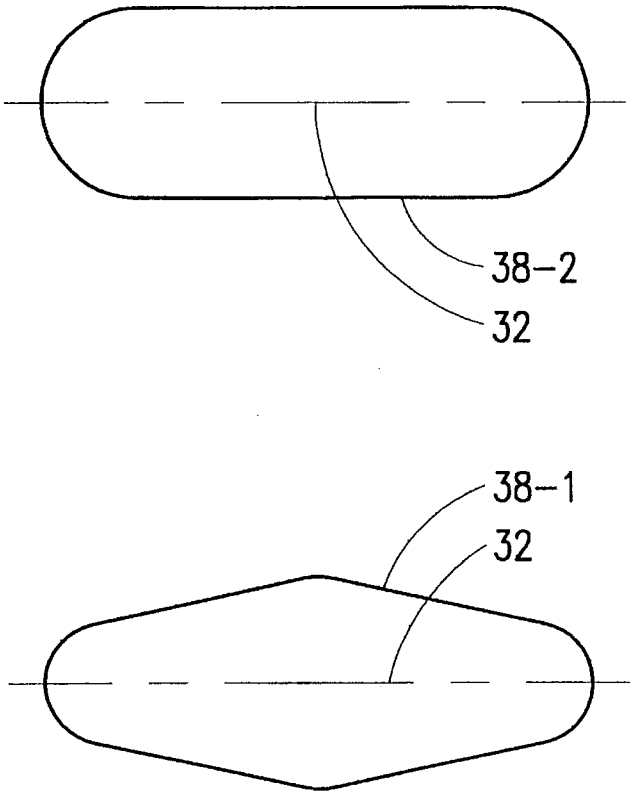

FIG. 16 is a plan view of two possible variations, among other possibilities, (not shown) of the opening in the control plate as well as the top of the dispenser which were found to function equally as well.

Figure 17:
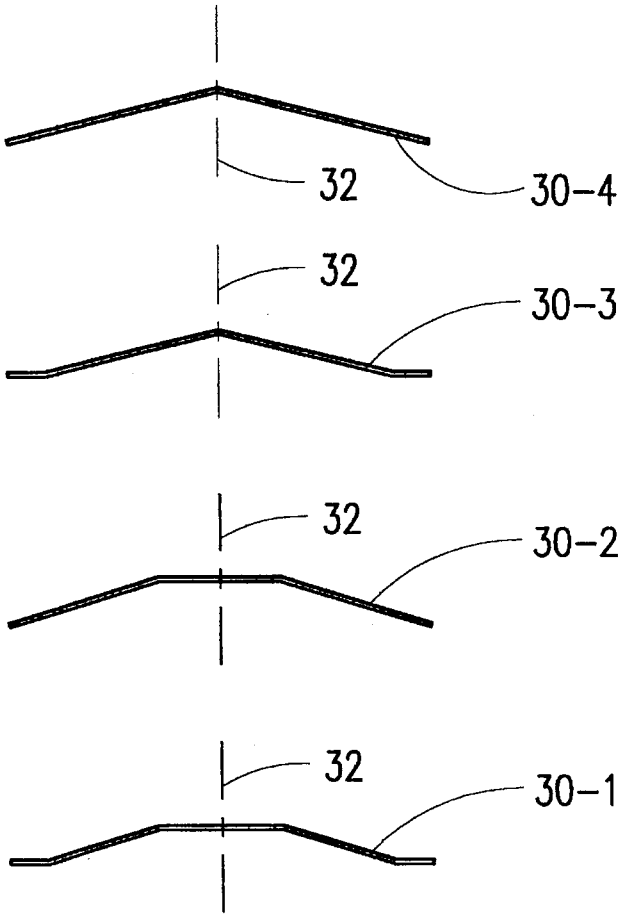

FIG. 17 is a group of end views, four possible variations, among other possibilities, (not shown) of various shapes to result in a "crown" in the control plate.

(6) DESCRIPTION OF THE PREFERRED EMBODIMENTS

Referring first to FIG. (1), there is indicated therein generally at (1) one embodiment of this tissue container in accordance with this invention. The device (1) includes an injection molded plastic container with a top (2) wherein an opening (10) is designed to permit the withdrawal of the tissue (22) vertically through the control plate (30) within the container from the packet of tissues (2) which is enclosed in the said container which has a top (2) opposing ends (4) and opposing sides (6) with an open bottom (8) in which is affixed a removable bottom (40) which supports the packet of tissues (2). Referring further to FIG. (1), the container (1) has in this instance an elliptical opening (10) with reinforced edges and will allow a persons hand or fingers to enter the top opening and not cause any discomfort or inconvenience in removing a tissue (22) which may have fallen within the container body. The opening, as shown, is in the form of an ellipse however, other designed openings to give the same control over the protruding tissue (22) would satisfy the requirements of this invention. The opening (10) also allows the container (1) to be picked up by inserting the fingers of the hand under the top surface of the top opening and supporting the weight of the container and tissues.

Referring to FIG. (2), the end sectional view through the container (1) shows the protruding tissue (22) extending up through the top opening (10) in the container (1) where the tissue is supported by the edges of the opening (10) and the tissue (22) is held vertical by the control plate (30) which rests on top of the tissue (21) which is the next tissue to be removed from the packet of tissues (20) inside the container. Also shown in FIG. (2) is the removable bottom (40) which supports the tissue packet and is held in place within the container. The bottom plate is fitted with felt pads (45) for protection of furniture surfaces or with Velcro (Velcro Canada Ltd., Quebec, Canada.) pads which allows the container to be attached to the cloth seat surfaces or to the floor mats of an automobile. Again referring to FIGS (2) the container (1) is shown with the top opening (10) which is reinforced and has opposite sides (6) and a top surface (2) and the control plate (30) resting on the tissue packet (20) with upswept wings (34) were the outer edges (36) rest on the next tissue (22) where it is removed through the opening (38) in the control plate.

Referring to FIG. 3, which is a sectional view through the side of the container (1) showing the bottom reinforced edge (9) on the side wall (6) and which supports the bottom (40) of the container. The bottom is held in place by the live hinge feature (42) at the parallel sides of the bottom plate. The bottom can be released from the restraint rib (44) by closing with the fingers of one hand the space (43) of the parallel side ribs (41) on the removable bottom (40). The packet of tissues (20) with the individual tissues (21) are shown inside the container along with the attachment pad locations (45).

Referring to FIG. 4, an isometric view of a typical tissue packet (20) which has a set width (20 W) and a set length (20 L) and a set count to give a height (20 H) of the packet of tissues (20) which are inter folded and interleaved in the C-Fold configuration or some other industry standard. The tissue inter folds create an inter layer friction between the tissue layers (24 and 25) and when a tissue is removed and pulled upwards by its leading edge (23) to the position (23A) the tissue corners (24) extend to location (24A) which then pulls the next successive tissue (25) vertically up to the location (25A) where it is progressively removed through the top opening (10) of the facial tissue container.

Referring to FIGS. 5 and 6, the end and plan view of the control plate (30) the crown is shown in the plate, symmetrically on the centerline (32) which results in an opening or space (39) under the crowned portion of the control plate. The upswept wings (34) of the control plate assist in positioning the control plate within the container and allow the opposite parallel edges (36) to rest inside the outer most edges of the tissue extreme edges on top of the tissue surface. The corners (37) of the control plate are rounded and upswept to prevent any snagging of the tissues when they are being removed through the elliptical opening (38) on the longitudinal centerline (32) of the control plate. The elliptical opening (38) in the control plate is a designed opening which allows the tissue to be supported vertically by its relative design to the size of the tissue and it allows the tissue to be supported vertically. Although an elliptical opening is shown in the drawings and referred to in the text and teachings, other engineered openings are possible, as shown in FIG. (16) and they will achieve to some degree the same desired effect of supporting the tissue in a vertical position as taught in this invention.

Referring now to FIG. (7), a vertical exploded view of the various elements of this invention, which shows the container and the various parts open to receive the packet of tissues where the container (1) has been elevated for clarity and the control plate (30) is shown above the tissue packet (20). The tissues are restrained by the wrapper (28) with the wrapper joint (29) or a line of weakness would be broken to release the compressed tissues (21) within the container (1). Also shown in the snap in place bottom plate (40) with extensions (46) to assist in supporting the packet of tissues (20) within the container. The felt and Velcro pad locations (45) are shown on the bottom and with alternate semipermanent fastener (47) locations.

Referring now to FIG. (8) a sectional end view of the tissue container (1) shows the respective parts of this embodiment where the container bottom (40) is attached to the container (1) and supports the packet of tissues (20) inside the container. As a tissue is withdrawn vertically from underneath the control plate (30). The location and position of the control plate assists in holding the partially withdrawn tissue (22) in a vertical upright position through the top opening (10) in the container. The substantial weight (60 grams) and the engineered shape of the control plate (30) maintains a constant pressure on the tissues as a tissue is partly withdrawn from underneath the crowned surface of the control plate. The tissue is controlled by the parallel edges (36) of the control plate which rest on the tissue (22) and the sloped under surface of the crowned control plate which controls the tissue as it is withdrawn through the opening (38).

Referring now to FIG. (9), which is a vertical section through the end view of the container and the various internal parts of the container (1) the packet of tissues (20) are as indicated and the control plate (30) has been raised vertically by the successive removal of a tissue (22) through the top opening (10) in the top (2) of the container. The floating control plate is allowed to oscillate on top of the tissue pack (20) as a tissue is removed (23) from underneath the parallel edges (36) of the control plate and through the opening (38) and as shown the control plate oscillates about the centerline of the container and maintains a pressure on the edges of the tissues. The pressure caused by the weight of the control plate on the edges of the tissues is such that the tissues will not tear when they are removed but will be supported vertically above the opening (38) in the control plate.

Referring to FIGS. 10, 11, 12 and 13; which show a possible method of manufacturing the packet of tissues (20) with a width (20 W) and length (20 L) composed of individual tissues (21) to a height of (20 H) is compressed by (20B) with conventional belt compression machinery (not shown) to a reduced height (20 A) and retained by a paper wrapper (28) or a plastic sleeve. The wrapper which encloses the rope of tissues forms a lap were a glue joint or heat seal (not shown) to the wrapper would restrain the compressed packet of tissues. The compressed packets are then accumulated in packages of six, nine or twelve or some other multiple of packets, where the length (20 L) and the width (2.20 W) or (3,20 W) are then further restrained (20 D) and placed inside a plastic poly wrapper (52) were the individual packets of tissues (20) now becomes a bulk pack of compressed tissue packets contained in a plastic poly wrapper (52) with a length (20 L) and a height (3.20 A). The width for six units (2.20 W) or with an alternate nine units (3.20 W) and the plastic wrapper (52) may also contain an integral carrying handle or strap (54). The bulk pack (50) of compressed facial tissue packets (20) is as shown in FIG. (13).

Referring to FIG. 14, is a possible manufacturing arrangement were the rope of tissues (21) would be carried forward on a conveyor line (67) and (63) were a conveyor belt compression station (60) would compress the tissues (33) and apply a paper or plastic wrap (38A) over and under the compressed rope of tissues were it would be folded (64) and heat or glue sealed (65) to seal (66) the wrapper and restrain the tissues as they are automatically cut (73) to length at the rotary cutting station (70) and then continue on as cut to length and compressed tissue packets (20).

Referring to FIG. 15, an isometric view of one possible variation of the bulk pack were the dispenser (1) is enclosed within the plastic poly wrapper (52) of the bulk pack (50). The compressed facial tissue packets (20) are also placed inside (20.1) the dispenser with the control plate (not shown) and the bottom (40) all enclosed within the plastic poly (52) wrapper with the carrying strap (54). Cost savings for packaging and shipping the dispenser as a separate item would be achieved with this bulk pack.

Referring to FIG. 16, a plan view of two possible variations of the centerline opening (38) in the control plate (30) and also the centerline opening (10) in the top (2) of the container or dispenser (1). The openings shown as (38-1), (38-2) as a parallelogram with rounded ends and a rectangular with rounded ends results in the same desired control over the vertical extension of the tissues as they are withdrawn as with the ellipse, used in the drawings to depict the opening. In each case the length and width of the openings are less than the length and width of the tissue in its flat condition which then causes the tissues to be hemmed or rolled at the outer ends to assist in holding the tissue vertical within the dispenser.

Referring to FIG. 17, an end view of four possible variations in the shape of the control plate (30) which would result in a space (39) under the plate. These four possible variations, amongst others, created a space which gave the desired control over the removal of the tissues. The edges (34) of the various control plates (30) although not upswept, resulted in a degree of vertical support and control over the tissues as desired in the invention.

It will also be understood that other modifications or variations can be made in the structures described herein without departing from the scope of the invention. Other variations and modification are possible and will be apparent to those conversent in container design with thermo plastic technology and with the technology already at hand by the various folded sheet manufacturers in the production of folded sheet products where convenience to the end user is of paramount importance and to those skilled in the art all within the intended spirit and scope of my invention.

Although only one embodiment of my top opening dispenser for facial tissues with the internal control plate has been shown and described, and as well in the compressed folded tissue packet and the bulk pack system, numerous variations within the spirit of the invention as defined in the appending claims will be obvious to those skilled in the art. Accordingly, the patent is not to be limited in scope and effect to the specific embodiments herein shown and described nor in any other way that is inconsistent with the extent to which the progress in the art has been advanced by my invention.

(8) Claims

The embodiments of the invention in which an exclusive property or privilege is claimed are defined as follows:

1. In combination with a packet of facial tissues within a restraint wrapper provided in a bulk pack, a refillable container adapted to receive said facial tissues, in the form of a supply of interleaved and interlayered tissues, said container being reusable and semipermanent and having an open bottom, a top, a pair of opposed end walls, and a pair of opposed side walls, an internal crowned control plate of substantial weight resting on said supply of facial tissue and being located between said top and said supply of facial tissues, said top having a convenient opening said control plate having an opening similar to the opening in said top for allowing a progressive one at a time removal of one tissue of said supply of facial tissues through said opening in said control plate and said opening in said top, said control plate controlling the one at a time removal by maintaining a friction between the interplys of the tissues.

2. A facial tissue container as defined in claim 1 where said top opening may be in the shape of an ellipse or parallelogram or some other convenient shape of a size to allow a persons hand or the fingers of the hand to be placed into the opening to assist in removing a facial tissue from the container.

3. A facial tissue container as defined in claim 1 with the control plate having a peripheral shape substantially the same as inside the top and configured to fit within the container and said plate having a longitudinal crown and upswept edges to rest inside the outer edges of the uppermost tissue.

4. A facial tissue container as defined in claim 1 where a space above the upper most tissue surface and under the crowned control plate allows the unrestricted withdrawal of the tissue through the centerline opening in the control plate and upwards vertically through the opening in the top of the container.

5. A facial tissue container as defined in claim 1 where the control plate has a shape where the opposed ends of the plate are in relative parallel contact with the opposed end walls of the container and the control plate has an opening on the centerline of the control plate in the same relative direction as said opening in the top of the container which allows the unrestricted removal of the tissues.

6. A facial tissue container as defined in claim 1 said control plate of substantial weight with parallel upswept edges which rest inside the outer edges of the top tissue at a controlled distance from the inside walls to maintain the correct amount of friction between the tissue interplys at the outer edges, when said tissue is removed vertically the control plate oscillates which allows the tissue to move upwards towards the crown of said plate where it has a controlled motion under said plate and upward through the opening to where the shape of the crown and the opening in the control plate creates the desired shape in the tissue to support the tissue as it is pulled upwards by the removal of the top tissue through the top opening in the container.

7. A facial tissue container as defined in claim 1 where said control plate has an opening on or about the centerline of the control plate in the shape of a parallelogram or ellipse or wherein said opening has a length which is about 60–80% of the length of said tissue which will effectively shape the edges of the tissue material to increase the rigidity of the tissue in the vertical direction.

8. A facial tissue container as defined in claim 1 where said bottom has a removable means which allows it to be detached or attached quickly and which has predetermined pad locations for protection or attachment purposes.

9. A facial tissue container as defined in claim 1 where said bottom supports a pack of facial tissues from a compressed packet of facial tissues or in a loose pack as when removed from a standard commercial tissue box.

10. A facial tissue container as in claim 1 wherein said container and said control plate are made from low cost molded plastic and preferably of a thermosetting type of plastic material.

11. A refillable container for dispensing tissues from a stack of folded tissues having reverse interleaved folds at opposite sides of said stack, said container including opposite side panels and opposite end panels for containing said stack with the opposite sides of said stack disposed adjacent side opposite side panels and ends of said stack disposed adjacent said end panels, and a crowned control plate of substantial weight having bottom tissue engaging surface portions for resting on a top of said stack, said control plate having an opening, said top panel having a tissue removal opening a centerline of said opening of said top panel being in alignment with the centerline of the container and also said stack of tissues, whereby a top tissue of said stack is accessible for removal vertically through said control plate, and due to friction resistance between said top tissue and an immediate subsequent tissue is drawn by the removal of said top tissue to an accessible position projecting vertically from said top panel.

12. A container as defined in claim 11, wherein said control plate is formed of a plastic material.

13. A container as defined in claim 12, wherein the bottom surface of said crowned control plate is convexed in cross section thereby providing a clearance between the top tissue of the stack longitudinal of the central portion of the control plate.

14. A container as defined in claim 13, wherein said control plate is substantially the width of said stack, and is provided with a pair of downwardly projecting ridges adjacent longitudinal side edges of said control plate, said ridges being transversely spaced a distance less than the width of said stack, said clearance being positioned between said ridges.

15. A refillable container for dispensing tissues sequentially from an interleaved stack of tissues, said tissues having reversed interleaved folds at opposite sides of said stack, said container including a pair of opposite end and side walls, a bottom panel and a top panel, and a crowned control plate of substantial weight having a convenient centerline opening for resting on a top of said stack, said top panel having an opening therein for vertical removal of one tissue at a time through said control plate and said top panel, said control plate having longitudinal side edges spaced apart a distance substantially equal to the width of said stack.

16. A container as defined in claim 15, wherein said crowned control plate provides clearance disposed between said transverse spaced stack engaging surface portions, said container has a pair of side panels spaced slightly greater than the width of said stack and the width of said control plate, said longitudinal edges of said control plate are upwardly turned from said stack engaging surface portions of said control plate, said container is a refillable container formed of a plastic material, said container includes a removable bottom panel for permitting the insertion of a fresh stack of tissues, and wherein side walls and said bottom panel include releasable interlocking means for normally holding said bottom in a closed position.

* * * * *